US008904642B2

(12) United States Patent
Hanna et al.

(10) Patent No.: US 8,904,642 B2
(45) Date of Patent: Dec. 9, 2014

(54) MANUFACTURING A VIBRATION DAMPED LIGHT METAL ALLOY PART

(75) Inventors: Michael D. Hanna, West Bloomfield, MI (US); John P. Miller, Howell, MI (US); Peter H. Foss, Oxford, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 251 days.

(21) Appl. No.: 13/204,764

(22) Filed: Aug. 8, 2011

(65) Prior Publication Data

US 2013/0036611 A1 Feb. 14, 2013

(51) Int. Cl.
*B21D 53/88* (2006.01)

(52) U.S. Cl.
CPC ..... *B21D 53/88* (2013.01)
USPC ..... 29/897.2; 29/527.2; 264/259; 164/98; 180/300

(58) Field of Classification Search
CPC ..... B21D 53/88
USPC ..... 29/458, 525, 527.1, 527.2, 897.2; 264/259; 164/98, 100, 112; 180/299, 180/300, 311
See application file for complete search history.

(56) References Cited

U.S. PATENT DOCUMENTS

| | | | | |
|---|---|---|---|---|
| 5,184,663 | A * | 2/1993 | Oono et al. | 164/98 |
| 7,594,568 | B2 | 9/2009 | Hanna et al. | |
| 7,644,750 | B2 * | 1/2010 | Schroth et al. | 164/100 |
| 7,775,332 | B2 | 8/2010 | Hanna et al. | |
| 7,937,819 | B2 | 5/2011 | Hanna et al. | |
| 7,938,378 | B2 | 5/2011 | Hanna et al. | |
| 7,950,441 | B2 | 5/2011 | Hanna et al. | |
| 7,975,750 | B2 | 7/2011 | Dessouki et al. | |
| 8,028,739 | B2 | 10/2011 | Walker et al. | |
| 8,056,233 | B2 | 11/2011 | Carter et al. | |
| 8,104,162 | B2 * | 1/2012 | Golden et al. | 29/527.1 |
| 2008/0099289 | A1 | 5/2008 | Hanna et al. | |
| 2008/0185249 | A1 | 8/2008 | Schroth et al. | |
| 2009/0020383 | A1 | 1/2009 | Hanna et al. | |
| 2009/0022938 | A1 | 1/2009 | Hanna et al. | |
| 2009/0032211 | A1 | 2/2009 | Hanna et al. | |
| 2009/0044923 | A1 | 2/2009 | Hanna et al. | |
| 2009/0071779 | A1 * | 3/2009 | Lowe et al. | 188/381 |
| 2009/0260931 | A1 | 10/2009 | Ulicny et al. | |
| 2009/0260932 | A1 | 10/2009 | Hanna et al. | |
| 2009/0260939 | A1 * | 10/2009 | Golden et al. | 188/381 |
| 2009/0269575 | A1 | 10/2009 | Hanna et al. | |
| 2010/0122880 | A1 | 5/2010 | Hanna et al. | |
| 2013/0112039 | A1 | 5/2013 | Hanna et al. | |

FOREIGN PATENT DOCUMENTS

| | | | |
|---|---|---|---|
| WO | 2010008715 | A2 | 1/2010 |

* cited by examiner

*Primary Examiner* — David Bryant
*Assistant Examiner* — Steven A Maynard
(74) *Attorney, Agent, or Firm* — Reising Ethington P.C.

(57) ABSTRACT

A method of manufacturing a non-ferrous, light metal alloy vibration-damped part for a vehicle chassis includes introducing a polymer insert into a cavity formed in the part. The polymer insert may be introduced into the cavity by separately fabricating the polymer insert and then sliding or maneuvering the insert into the cavity or by injecting a liquid polymer material into the cavity and then solidifying and shrinking the liquid polymer material into the polymer insert. The vibration-damped light metal alloy part can damp vibrations that originate within or are imparted to the part when such vibrations effectuate relative contacting frictional movement between an exterior surface of the polymer insert and an interior surface of the cavity.

20 Claims, 6 Drawing Sheets

MANUFACTURING A VIBRATION DAMPED LIGHT METAL ALLOY PART

TECHNICAL FIELD

The technical field of this disclosure relates generally to a method of manufacturing a vibration-damped, non-ferrous, light metal alloy part that includes a cavity and a vibration-damping polymer insert disposed within the cavity. The vibration-damped light metal alloy part is preferably a housing, a bracket, or some other part contained in a vehicle chassis that is prone to vibration propagation and noise transmission.

BACKGROUND

The chassis of a vehicle includes a structural frame and a powertrain supported by the frame. The powertrain includes a variety of components that generate and transfer power to enable an operator to drive the vehicle. Some of the components that make up the powertrain include, for example, an internal combustion engine, a transmission, a differential, and, additionally, in the case of a hybrid-electric vehicle, an invertor and an electric motor. Many of these components includes parts, such as housings or covers, that are now being manufactured from light metal alloys instead of heavier steel alloys to promote vehicle weight reduction and fuel efficiency. The particular light metal alloys currently being used are aluminum alloys and magnesium alloys.

The normal operation of a vehicle employs many different mechanical motions and interactions within the vehicle chassis to provide driving and steering capabilities. Clutches and gears are routinely engaged and disengaged, the reciprocating motion of pistons within engine block cylinders is accelerated and decelerated, and crankshafts, camshafts, and axles are rotated at varying speeds, to name but a few of the mechanical motions and interactions that regularly transpire during vehicle use. Each of these mechanical events may cause or exacerbate the reverberation of vibrations through the vehicle chassis. These vibrations can sometimes be felt and, if they fall within a particular frequency, heard by the operator of the vehicle as well as any other commuters that may be present in the passenger compartment.

Similar vibration and noise concerns have been identified in other locations of a vehicle—most notably the braking system. One approach that has been considered to alleviate the effects of braking-induced vibrations is to place a metallic or ceramic insert within a cast iron brake rotor where intense frictional interactions are experienced with selectively actuated brake pads. The metallic or ceramic insert is disposed within a cheek portion of the brake rotor so that relative interfacial frictional contact can occur between an exterior surface of the insert and an interior surface of the cheek portion during braking. This relative movement converts mechanical, oscillatory energy into thermal energy by way of friction to help subdue vibration propagation and noise generation. The cast iron brake rotor and the metallic or ceramic insert are specifically constructed to withstand the constant frictional stress applied by the nearby brake pads and the relatively high surface temperatures often generated. But this type of selective frictional stress and rapid heat generation is not typically experienced by the non-ferrous, light metal alloy parts present in the vehicle powertrain and the supporting frame.

What is needed is a simple yet effective manufacturing method for introducing a vibration damping insert into any of the non-ferrous, light metal alloy parts installed in a vehicle chassis. The role of the vibration damping insert is to alleviate the actual and/or perceived discomfort associated with vibrations and noise that emanate from the chassis during vehicle operation. A wider range of manufacturing options and more lenient material constraints are potentially available for the vibration damping insert as compared to the vibration damping work associated with a disc brake rotor braking system.

SUMMARY OF THE DISCLOSURE

The chassis of a gasoline-fueled, a diesel-fueled, a hybrid gas-electric, or an all-electric vehicle includes a structural frame that supports a powertrain. The powertrain includes a set of components that, collectively, generate and transfer power so the vehicle can be driven as intended. Some of the components that may form part of the powertrain include an internal combustion engine, a manual or automatic transmission, a transfer case, a differential, an invertor, and an electric motor. Each of these components may be constructed from or supported by one or more non-ferrous, light metal alloy parts. A non-exhaustive listing of the parts most likely to be formed from such light metal alloys includes the housings that enclose the inner workings of the components and the brackets that support the components within the frame. The non-ferrous, light metal alloys currently being used by the automotive industry as a substitute for steel are aluminum alloys and, to a lesser extent, magnesium alloys.

A method of manufacturing the vibration-damped, non-ferrous, light metal alloy part involves introducing a polymer insert into a cavity formed in the part. The cavity is formed within the structure of the light metal alloy part at a selected damping region either while the part is being fabricated or at a later, post-fabrication time. The selected damping region is a predefined section of the light metal alloy part where vibrations originate, where vibrations can be optimally damped by the polymer insert, and/or where the polymer insert can be most easily introduced. Exactly what constitutes the selected damping region can be determined by experience or the interpretation of relevant empirical data, experimental data, and/or computer modeling. The presence of the polymer insert within the cavity damps vibration propagation at the selected damping region by promoting relative frictional contacting movement between the polymer insert and the light metal alloy part at a boundary interface within the cavity.

The size and shape of the cavity can vary so long as the structural integrity and/or the functionality of the light metal alloy part is not compromised. The cavity may, for instance, be a simple generally uniform slot without any bends or curvature or, alternatively, it may take on a complex geometrical shape that emulates the contour of the light metal alloy part at the selected damping region. The cavity is delineated by an interior surface within the bulk structure of the part. An internally exposed bulk surface of the light metal alloy part or a non-wettable coating that has been applied over such a surface may constitute the interior surface. The non-wettable coating may be applied to reduce potential binding or sticking interactions with the polymer insert and/or to help introduce the insert into the cavity, as further explained below. A typical formulation of the non-wettable coating is graphite or ceramic particles, or both, dispersed within and held together by a binder.

Several different techniques may be used to form the cavity at the selected damping region. In one embodiment, the cavity may be integrally formed while the light metal alloy part is being fabricated. A process such as sand casting or powder metallurgy can easily be tailored to fabricate the light metal alloy part along with the cavity in almost any desired size and shape. In another embodiment, the cavity may be formed in the light metal alloy part after the part has been fabricated. Several different processes may be employed to fashion the cavity in this manner including electrical discharge machining, laser cutting, water jet cutting, milling, broaching, chemical etching, or any other suitable technique. The decision on whether to form the cavity during or after fabrication of the light metal alloy part is usually a matter of manufacturing capabilities, production economics, and manufacturing logistics. The non-wettable coating, if utilized, is applied before the polymer insert is introduced into the cavity.

The polymer insert resides within the cavity so that relative frictional contacting movement occurs between an exterior surface of the polymer insert and the interior surface of the cavity when vibrations or oscillatory forces are imparted to the selected damping region. A portion of the exterior surface of the polymer insert lies against the interior surface of the cavity and another portion is separated from the interior surface by a small gap. The portion that lies against the interior surface is responsible for converting mechanical vibratory energy into thermal energy by way or interfacial frictional engagement with the interior surface of the cavity. The portion that is separated from the interior surface provides the polymer insert with a degree of flexibility and room for independent localized movement. This type of independent movement allows the insert to dissipate mechanical vibratory energy received through the portion that lies against the interior surface and, accordingly, contributes to the overall vibration damping effect of the polymer insert.

The polymer insert may be constructed from either thermoplastic or thermoset polymers that shrink when solidified from a liquid state by cooling and/or curing. Some preferred thermoplastic polymers that exhibit such shrinkage capacity include an aliphatic polyamide such as polyhexamethylene adipamide (nylon 6,6) or polycaprolactam (nylon 6), an aromatic polyamide such as the reaction product of p-phenylenediamine and terephtaloyl chloride, a polycarbonate such as the reaction product of bisphenol-A and phosgene, a polyacrylic such as poly(methyl methacrylate), a polyolefin such as polypropylene or polyethylene, and a polyester such as polyethylene terephthalate or polybutylene terephthalate. Some preferred thermoset polymers that exhibit the necessary shrinkage capacity include an epoxy such as the reaction product of bisphenol-A and epichlorohydrin, a phenolic such as the reaction product of phenol and formaldehyde, and a polyester such as the reaction product of ethylene glycol and maleic acid. The uncured thermoset polymer may be cured by heating to promote polymerization and crosslinking, UV light exposure in the presence of a photoinitiator, a chemical reaction (i.e., mixing a polyamine hardner with the epoxy), or irradiation.

The polymer insert may be introduced into the cavity in several ways depending on the size and geometric complexity of the cavity. One way involves separately molding the polymer insert and then sliding or maneuvering the insert into the cavity. This technique works best when the cavity is easily accessible and lacks complex curves, bends, or cross-sectional profiles. Another way to introduce the insert involves injecting a liquid polymer material composed of the desired thermoplastic or uncured thermoset polymer into the cavity and then solidifying and shrinking the liquid polymer material into the polymer insert. This technique is most useful when the cavity embodies a geometric shape through which the progression of a pre-formed polymer insert is not practical or even viable (although this technique may be used for a cavity of very simple shape as well). The optional non-wettable coating may be applied within the cavity before injection of the liquid polymer material if concerns arise about the solidifying liquid polymer material possibly sticking or binding to the bare internally exposed bulk surface of the light metal alloy part. After the polymer insert is introduced, the cavity may be left uncovered or sealed. The cavity may be sealed with a corresponding light metal alloy joint, for example, by a welding or brazing operation if a seal is desired.

The polymer insert may include a filler for a variety of reasons. The filler can be used, for example, to control the stiffness or the shape profile of the polymer insert and/or to control the shrinkage rate of the liquid polymer material as it solidifies (if such a technique is used to introduce the polymer insert into the cavity). The more filler contained in the polymer insert generally coincides with an increase in stiffness and, if the insert is introduced into the cavity by injecting the liquid polymer material, a slower shrinkage rate and less overall shrinkage of the liquid polymer material. A shrinkage rate ranging from about 50 mm/m (millimeters shrinkage per linear meter) to about 2 mm/m can be achieved for the solidifying liquid polymer material depending on the amount, composition, and structural form of the filler. Precisely how much of the filler is accommodated by the polymer insert is subject to many factors. But in most instances the polymer insert contains anywhere from about 5 wt. % to about 50 wt. % of the filler if present.

The fillers may be uniformly or locally accommodated within the polymer insert and may embody particles of spherical shape, planar shape, or fibrous shape, as well as a fibrous sheet comprised of a unidirectional fiber or a bidirectional woven fabric. Any single material or combination of materials that are relatively heat resistant and corrosion resistant may be used as the filler. Some examples of common and broadly-applicable filler materials are calcium carbonate, silica, glass, talc, clay, nanoclay, natural or synthetic carbon, aromatic polyamides (i.e., Kevlar), and wollastonite. The various filler materials and their different structural forms that may constitute all or part of the filler have different physical attributes; as such, they can manipulate the shrinkage direction of the solidifying liquid polymer within the cavity in addition to slowing the shrinkage rate. The difference in aspect ratios (ratio of long dimension vs. short dimension) of the particulate filler materials, for example, influences whether the liquid polymer material shrinks isotropically (generally spherical particles) or anisotropically (planar particles, fibers) during solidification. The fibrous sheet filler materials can also similarly influence the shrinking behavior of the solidifying liquid polymer material in addition to setting a rough shape profile for the polymer insert.

A preferred embodiment of the vibration-damped light metal alloy part is a transmission housing that encloses a portion of an input shaft, a portion of an output shaft, and a gear train that is operated, either manually or automatically, to selectively transfer speed and torque from the input shaft to the output shaft. Many other mechanical elements may also be enclosed in the vibration-damped transmission housing along with the gear train including clutch plates, synchronizers, a flywheel, a torque converter, and bearings, to name but a few examples. It should be noted that skilled artisans are well aware of the general function of a transmission, the many transmission design options that are currently available, the many specific mechanical elements that are often used to assemble the mechanical workings of the transmission, and how those mechanical elements interact with one another to effectively facilitate the overall function of the transmission. A more in-depth discussion on the complex and interrelated mechanical workings that are enclosed by the transmission housing is therefore not necessary here.

The vibration-damped transmission housing comprises a structural wall composed of either of an aluminum alloy or a magnesium alloy. The structural wall includes an inner surface and an outer surface. A cavity that emulates the contour of the structural wall is formed between the inner surface and the outer surface at a selected damping region. Contained within the cavity is a polymer insert that preferably accommodates a filler to help achieve and maintain a desired size, stiffness, and shape profile. A portion or several portions of an exterior surface of the polymer insert lie against an interior surface of the cavity and are able to experience relative frictional contacting movement at that interface when vibrations are imparted to the selected damping region of the transmission housing. The interior surface of the cavity is preferably provided by a non-wettable coating.

The constant engagement and disengagement of the individual meshed gears within the gear train and the other various mechanical interactions (i.e., those encountered by the flywheel, clutch plates, etc.) that occur during transmission operation may cause vibrations to be imparted to the vibration-damped transmission housing. Vibrations may also be imparted to the vibration-damped transmission housing from other sources within the vehicle powertrain. But the presence of the polymer insert within the cavity disrupts the propagation of those vibrations and dissipates an appreciable amount of their mechanical energy into thermal energy. The relative frictional contacting movement that occurs between the exterior surface of the polymer insert and the interior surface of the cavity when the transmission housing is subjected to vibrations is primarily responsible for the conversion of mechanical vibratory energy into heat. The independent movement of the portion of the polymer insert not in contact with the interior surface of the cavity also contributes to damping effect of the polymer insert. The overall damping effect attainable by the vibration-damped transmission housing means the vehicle operator is much less likely to feel the vibrations or hear noise produced by those vibrations.

Of course the many other components present in the vehicle chassis in addition to the transmission may similarly include a vibration-damped light metal alloy housing. These other components include the inverter and/or the electric motor. Other light metal alloy parts, for example, a bracket, may also be vibration-damped in a similar manner. The use of one or more vibration-damped light metal alloy parts in the vehicle chassis helps reduce vibration propagation and potential noise generation along the powertrain for added driving comfort in the passenger compartment.

DETAILED DESCRIPTION OF PREFERRED EMBODIMENTS

Figure 1:
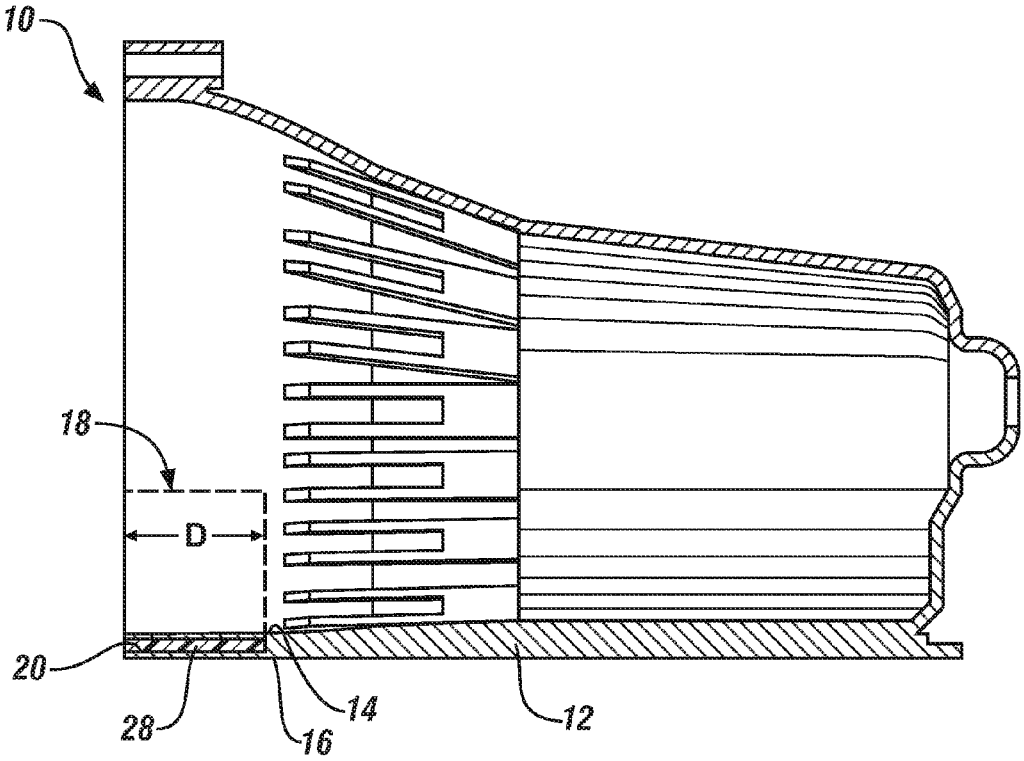
FIG. 1, as an exemplary embodiment of a light metal alloy part found in a vehicle chassis, is a cross-sectional view of a vibration-damped transmission housing that includes a polymer insert that has been introduced into a cavity formed in a structural wall of the housing at a selected damping region.
Figure 2:
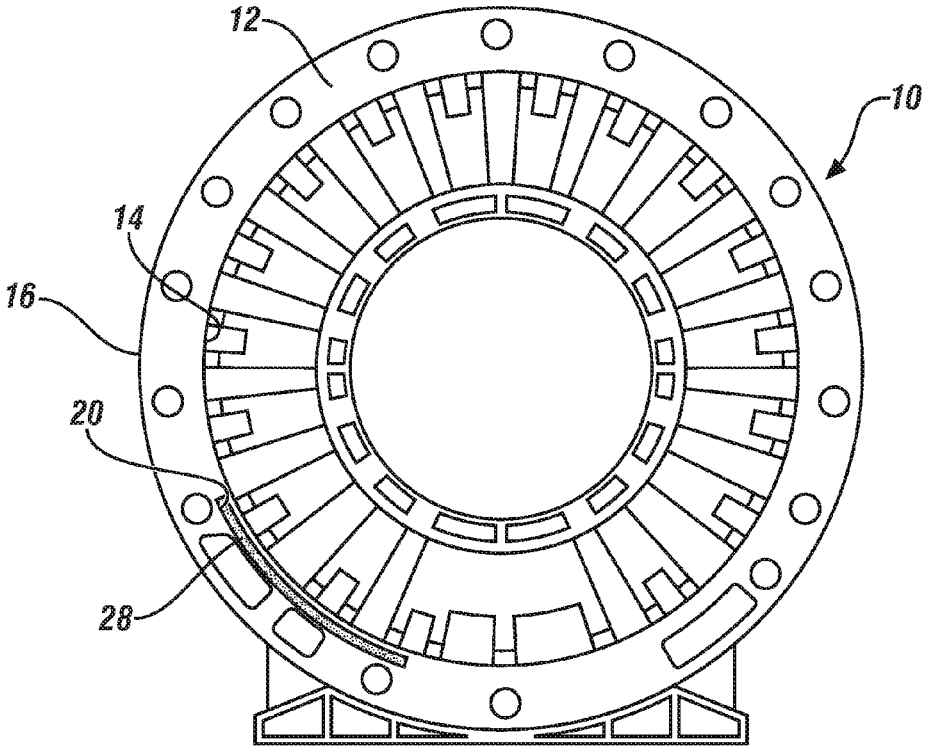
FIG. 2 is a plan view taken along the longitudinal axis of the transmission housing illustrated in FIG. 1.
Figure 3:
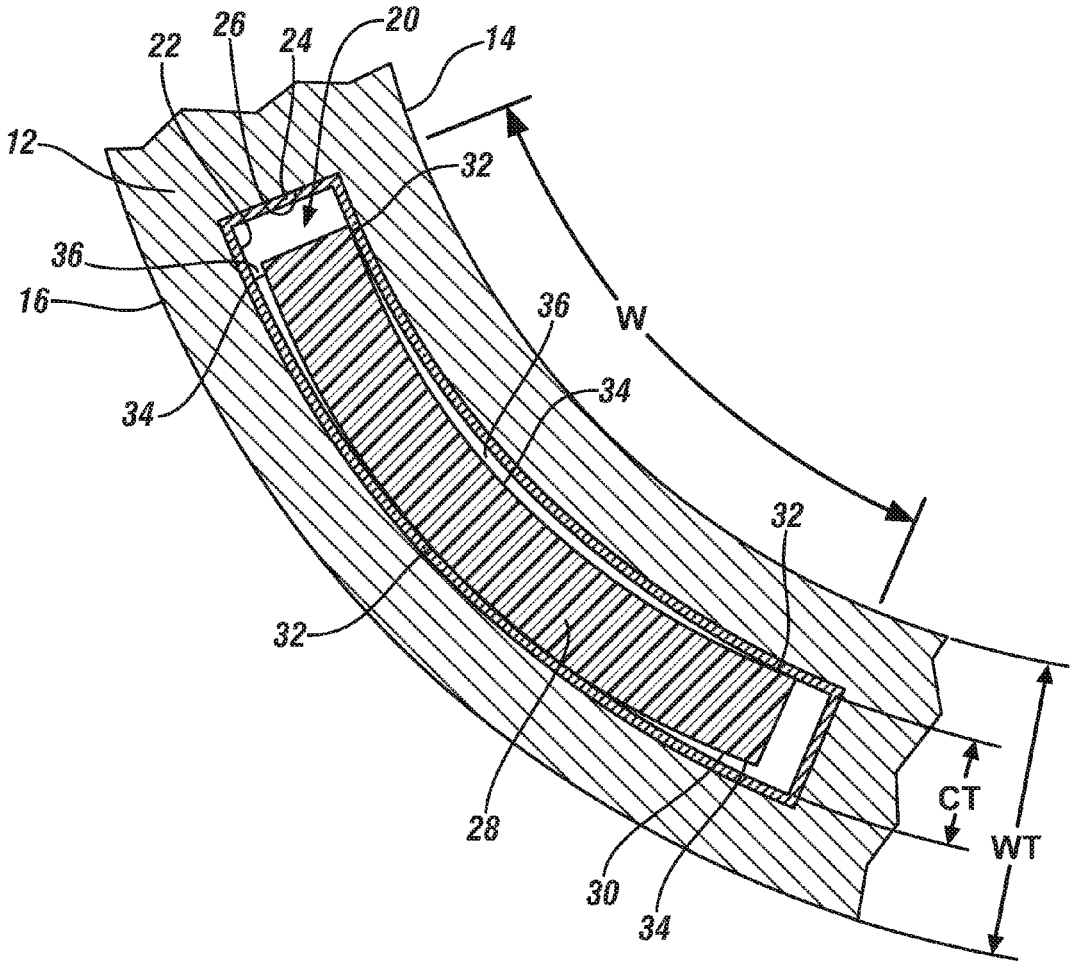
FIG. 3 is a magnified view of the cavity and the polymer insert contained in the cavity as identified by circle 3 in FIG. 2.

A vibration-damped transmission housing 10 is shown in FIGS. 1-3 as an exemplary embodiment of a light metal alloy part that may be found in a chassis of a vehicle. The vibration-damped transmission housing 10 is the enclosure structure of a transmission; it encloses, among others, a portion of an input shaft, a portion of an output shaft, and a gear train. The transmission is part of a powertrain which is supported by a structural frame. The overall function of the transmission is to transfer speed and torque, either manually or automatically, from the power-generating components of the powertrain (engine or battery) to the drive wheels at a desired gear ratio consistent with a selected gear position (forward, neutral, reverse). The vibration-damped transmission housing 10 protects the gear train and other enclosed mechanical transmission elements from debris and, if applicable, provides containment for a lubricating transmission fluid.

The vibration-damped transmission housing 10 comprises a structural wall 12 composed of a light metal alloy. The structural wall 12 includes an inner surface 14 and an outer surface 16. Defined within the structural wall 12 between the inner surface 14 and the outer surface 16 at a selected damping region 18 is a cavity 20. The selected damping region 18 may be any predefined section of the structural wall 12 in which the relevant experience of a skilled artisan, empirical data, and/or experimental data suggests that vibrations are likely to originate or propagate. Large, accessible areas of the structural wall 12 without highly intricate and complex geometric contours are the most preferred locations for the damping region 18. These areas offer more room for the cavity 20 to be formed and allow more design latitude regarding the shape of the cavity 20. The light metal alloy from which the structural wall 12 is composed may be an aluminum alloy or a magnesium alloy such as, for example, aluminum alloys A360, A380, A383, and A413 or magnesium alloys AZ91D, AZ81, AM60B, AM50A, and AS41B.

The size and shape the cavity 20 at the selected damping region 18 can vary so long as the structural integrity and/or the functionality of the structural wall 12 is not compromised. For example, as shown best in FIG. 3, the cavity 20 may emulate the contour of the adjacent inner and outer surfaces 14, 16 of the structural wall 12. The thickness CT of the cavity 20—as measured in a direction consistent with a thickness measurement of the structural wall 12 from the inner surface 14 to the outer surface 16—preferably ranges from about 0.3 mm to about 5.0 mm given a structural wall thickness WT of about 5 mm to about 20 mm. The other two dimensions of the cavity 20 (width W and depth D) are less crucial to the structural and functional integrity of the structural wall 12. But in general the width W and depth D of the cavity 20 each preferably span about 15 mm to about 150 mm in their respective dimension within the structural wall 12.

The cavity 20 is delineated by an interior surface 22 that, in this particular embodiment, is provided by a non-wettable coating 24 applied over an internally exposed bulk surface 26 of the structural wall 12. The non-wettable coating 24 provides an interface less prone to binding interactions than the internally exposed bulk surface 26 and aids in manufacturing the friction-damped transmission housing 10, as further explained below. The non-wettable coating 24 preferably includes graphite particles, ceramic particles, or both, dispersed within a binder. A typical thickness of the non-wettable coating 24 is preferably no more than about 10% of the cavity thickness CT. But of course the non-wettable coating 24 does not have to be present within the cavity 20. The internally exposed bulk surface 26 of the structural wall 12 could provide interior surface 22 of the cavity 20 without drastically diminishing vibration damping efficacy.

One specific composition of the non-wettable coating 24 may include flakes, fibers, and/or powder particles of natural or synthetic graphite dispersed in an epoxy resin or phosphoric acid binding agent. The graphite particles (flakes, fibers, powder) may be present at about 30 wt. % to about 95 wt % based on the total weight of the non-wettable coating 24. Another specific composition of the non-wettable coating 24 may include ceramic particles such as, for example, those of silica, alumina, silicon carbide, silicon nitride, boron nitride, cordierite (magnesium-iron-aluminum silicate), mullite (aluminum silicate), zirconia (zirconium oxide), phyllosilicates, or any other known ceramic material. The ceramic particles may be dispersed in an epoxy resin, a phosphoric acid binding agent, a calcium aluminate cement, wood flour, a clay, or a lignosulfonate binder such as calcium lignosulfonate. One such coating composition is commercially available from Vesuvius Canada Refractories (Welland, Ontario) under the tradename IronKote. The IronKote coating composition is composed of alumina particles (about 47.5%) and silicate particles (about 39.8%) dispersed in a lignosulfonate binder.

A polymer insert 28 resides within the cavity 20 and contributes a vibration-damping effect to the transmission housing 10. More specifically, an exterior surface 30 of the polymer insert 28 experiences relative frictional contacting movement with the interior surface 22 of the cavity 20 when vibrations or oscillatory forces reverberate through the structural wall 12 at the selected damping region 18. These frictional interactions convert mechanical vibratory energy into dissipating thermal energy which, in turn, weakens or substantially subdues the propagating vibrations. The exterior surface 30 of the polymer insert 28 includes a portion 32 that lies against the interior surface 22 of the cavity 20 and a portion 34 that is separated from the interior surface 22 by a small gap 36. The portion 32 that lies against the interior surface 22 is responsible for converting mechanical vibratory energy into thermal energy by way of frictional contact. The portion 34 that is separated from the interior surface 22 provides the polymer insert 28 with a degree of flexibility and room for independent localized movement through which some mechanical vibratory energy can be absorbed. These portions 32, 34 of the exterior surface 30 of the polymer insert 28 can be formed and accentuated by the geometric shape of the cavity 20, the technique by which the polymer insert 28 is introduced into the cavity 20, and the composition of the polymer insert 28.

The polymer insert 28 may be constructed from either a thermoplastic polymer or a thermoset polymer that shrinks when solidified from a liquid state. Some preferred thermoplastic polymers that exhibit such shrinkage capacity include an aliphatic polyamide such as polyhexamethylene adipamide (nylon 6,6) or polycaprolactam (nylon 6), a polycarbonate such as the reaction product of bisphenol-A and phosgene, an aromatic polyamide such as the reaction product of p-phenylenediamine and terephtaloyl chloride, a polyacrylic such as poly(methyl methacrylate), a polyolefin such as polypropylene or polyethylene, and a polyester such as polyethylene terephthalate or polybutylene terephthalate. These and other thermoplastic polymers can be solidified from a molten state by cooling to a temperature below their melting temperature. Some preferred thermoset polymers that exhibit the necessary shrinkage capacity include an epoxy such as the reaction product of bisphenol-A and epichlorohydrin, a phenolic such as the reaction product of phenol and formaldehyde, and a polyester such as the reaction product of ethylene glycol and maleic acid. These and other thermoset polymers can be solidified by curing through heating, UV light exposure in the presence of a photoinitiator, irradiation, or a chemical reaction that initiates polymerization and/or crosslinking (i.e., adding a polyamine hardner to the epoxy).

A filler may be accommodated within the polymer insert 28 for several reasons. The presence of the filler can be used to control the size, stiffness, and/or shape profile of the polymer insert 28. The filler may be uniformly or locally accommodated within the polymer insert 28 and may embody spherical particles, planar particles, fiber particles, a unidirectional fiber insert, and/or a bidirectional woven fabric insert. Any single material or combination of materials that are relatively heat resistant and corrosion resistant may be used as the filler. Some examples of common and broadly-applicable filler materials are calcium carbonate, silica, glass, talc, clay, nanoclay, carbon, aromatic polyamides (i.e., Kevlar), and wollastonite. The various filler materials and their different structural forms have different physical attributes and, consequently, can impart different structural properties to the polymer insert 28 in accordance with the general knowledge of skilled artisans. The exact amount of the filler accommodated by the polymer insert 28 is not particularly restricted but usually ranges from about 5 wt. % to about 50 wt. % of the total weight of the polymer insert 28.

Figure 4:
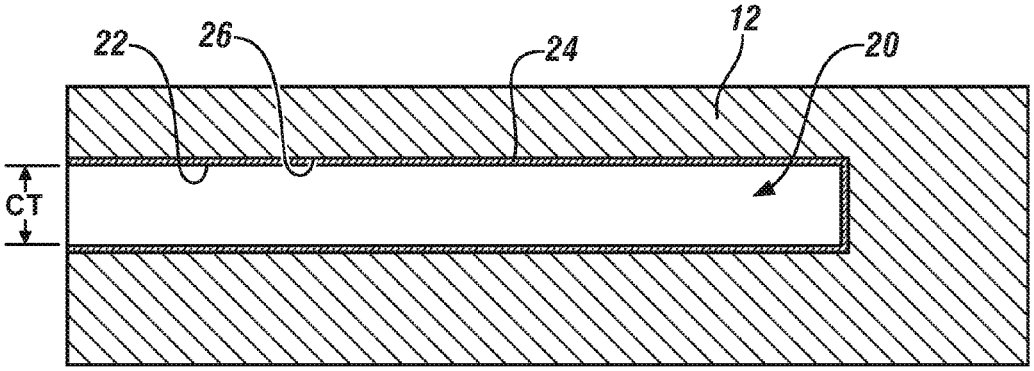
FIG. 4 is a magnified, idealized view of the cavity, taken along line 4 in FIG. 1, before injection of a liquid polymer material that solidifies and shrinks to become the polymer insert, according to one embodiment of the disclosed manufacturing method.
Figure 5:
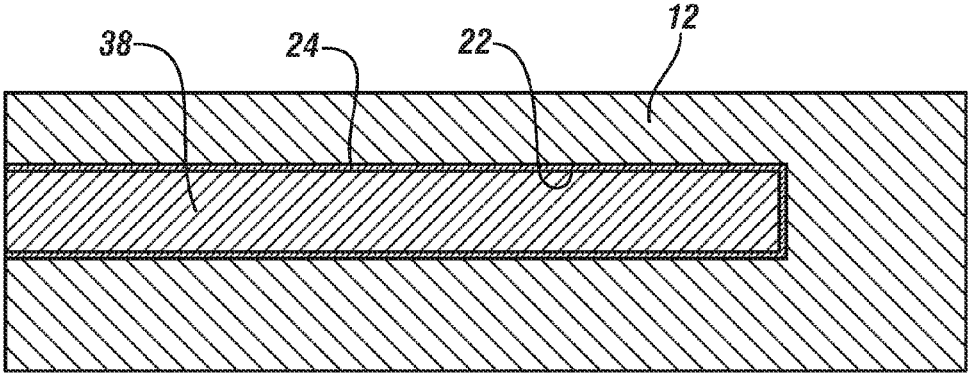
FIG. 5 is a magnified, idealized view of the cavity shown in FIG. 3 after injection of the liquid polymer material but before solidification and shrinking.
Figure 6:
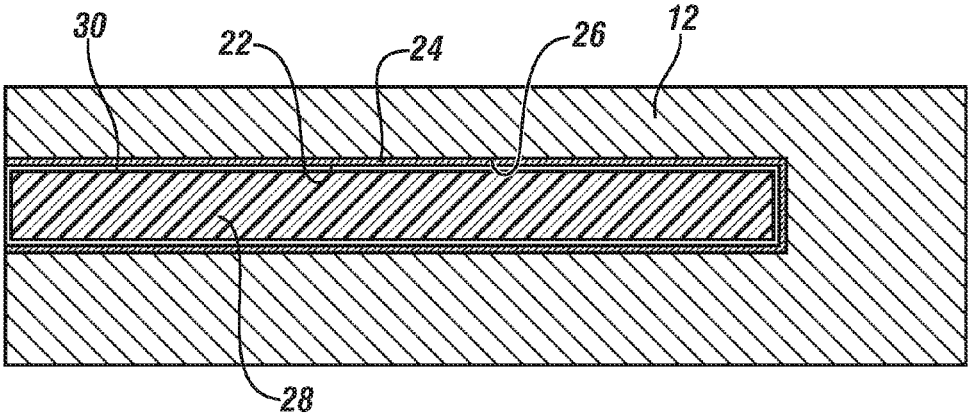
FIG. 6 is a magnified, idealized view of the cavity shown in FIG. 3 after the injected liquid polymer material has solidified and shrunk into the polymer insert.

A preferred method of manufacturing the vibration-damped transmission housing 10, as schematically illustrated in FIGS. 4-6, involves injecting a liquid thermoplastic or uncured thermoset polymer material 38 into the cavity 20 and then solidifying and shrinking the liquid polymer material 38 to form the polymer insert 28. This technique is most useful when the cavity 20 embodies a geometric shape through which the ingress and progression of the polymer insert 28, if formed separately outside of the cavity 20, would not be practical or even viable. After the polymer insert 28 is introduced, the cavity 20 may be left uncovered or, alternatively, it may be sealed with a corresponding light metal alloy joint by way of welding or brazing if desired under the circumstances. This particular technique of introducing the polymer insert 28 can also be used in instances where the cavity 20 embodies a very simple shape amenable to slideable ingress and egress of the insert 28.

The cavity 20, as shown in FIG. 4, is formed at the selected damping region 18 either during fabrication of the structural wall 12 or after the structural wall 12 has been made. The cavity 20 may be formed integrally and simultaneously with the structural wall 12 during sand casting, a powder metallurgical process, or any other type of suitable light metal alloy fabrication process known to skilled artisans. The cavity 20 could also be formed after the structural wall 12 has been fabricated. Techniques that may be employed to form the cavity 20 in such a manner include electrical discharge machining, laser cutting, water jet cutting, milling, broaching, chemical etching, or any other suitable technique. The decision whether to form the cavity 20 during or after fabrication of the structural wall 12 is generally a matter of manufacturing capabilities, production economics, and manufacturing logistics.

The non-wettable coating 24, if utilized, is then be applied over the internally exposed bulk surface 26 of the structural wall 12 by pressurized roll-coating, spraying, or dip-coating. The non-wettable coating 24 is typically applied if there is a concern about the liquid polymer material 38 possibly sticking or bonding to the internally exposed bulk surface 26 during solidification. Such surface-to-surface interactions are generally not desirable because they would inhibit the relative frictional contacting movement that is intended to occur between the outer surface 30 of the insert 28 and the interior surface 22 of the cavity 20. The non-wettable coating 24, as compared to the internally exposed bulk surface 26 of the structural wall 12, is less likely to experience sticking or bonding interactions with the liquid polymer material 38 during solidification, or with the exterior surface 30 of the polymer insert 28 during extended use, on account of the dry lubricating properties of its surface-bound graphite and/or ceramic particles.

The liquid polymer material 38, as shown in FIG. 5, is then injected into the cavity 20 under conditions which allow its component thermoplastic or uncured thermoset polymer to flow. For a thermoplastic polymer, the temperature of the liquid polymer material 38 is generally above the melting temperature of the particular thermoplastic polymer being used. Heating and melting a thermoplastic polymer into the liquid polymer material 38 can be achieved by any suitable approach such as, for example, exposure to heat in an injection molding machine. For an uncured thermoset polymer, on the other hand, the temperature may or may not be an issue depending on whether the particular thermoset polymer is cured through heating or another mechanism. A heat-cured thermoset polymer is generally injected at a temperature below the temperature at which polymerization/crosslinking is initiated while a reaction-cured thermoset polymer can be injected just after mixing the uncured thermoset polymer with an appropriate hardener or crosslinking agent at a temperature that provides the desired viscosity and cure rate. The specific storage, handling, and preparation procedures needed to cultivate the flowable, liquid polymer material 38 from the many different thermoplastic and uncured thermoset polymer candidates are generally known to skilled artisans and, as such, need not be further elaborated here.

The liquid polymer material 38 may, but does not have to, encompass the filler when present in the cavity 20. The filler can be used to affect the stiffness and shape profile of the polymer insert 28 and also to control the shrinkage rate of the liquid polymer material 38 as it solidifies, through cooling and/or curing, into the polymer insert 28. An increase in the amount of filler generally coincides with (1) an increase in the stiffness of the polymer insert 28 and (2) a steady decrease in the shrinkage rate and overall shrinkage of the liquid polymer material 38. The filler, if present, and depending on its construction, may be disposed within the cavity 20 separate from the liquid polymer material 38 or, alternatively, may be mixed with the liquid polymer material 38 for simultaneous injection. The more structurally unified fibrous sheet fillers (unidirectional fiber insert, bidirectional woven fabric insert) are preferably disposed within the cavity 20 separate from the liquid polymer material 38 while the particulate fillers (spherical particles, planar particles, fibers particles) are preferably mixed with the liquid polymer material 38 before injection into the cavity 20.

The liquid polymer material 36 is then solidified within the cavity 20 to form the polymer insert 28, as shown in FIG. 6. Solidification of the liquid polymer material 38 may proceed linearly or non-linearly and is accompanied by shrinking of the solidifying liquid polymer material 36 at a somewhat controllable shrinkage rate. The distinction between a thermoplastic polymer and an uncured thermoset polymer is again a relevant factor in how the liquid polymer material 38 solidifies. The liquid polymer material 38, when composed of a thermoplastic polymer, progressively solidifies and shrinks when cooled below the melting temperature previously-eclipsed in order to support injection into the cavity 20. A simple lapse of time at ambient temperature is usually sufficient to cool the thermoplastic polymer to the extent needed. But when composed of an uncured thermoset polymer, the liquid polymer material 38 typically solidifies and shrinks during curing which may be facilitated by the addition of heat, a hardener or a crosslinking agent, a photoinitiator and UV light energy, irradiation, or the passage of time so that sufficient polymerization and crosslinking can materialize between constituent monomers and/or oligomers.

The shrinkage of the solidifying liquid polymer material 38 not only avoids a tight fit between the polymer insert 28 and the cavity 20 to permit relative frictional contacting movement to occur but also contributes to the final structure of the polymer insert 28. This is because the solidifying liquid polymer material 38 often shrinks out of conformity with the shape of the cavity 20. Dimensional differences in the thickness CT, width W, and depth D of the cavity 20 have a tendency to promote internal stresses that cause the polymer insert 28 to buckle as it is being formed. Such buckling contributes to the formation of the portion 32 that lies against the interior surface 22 and the portion 34 that is separated from the interior surface by a gap 36 (as shown in FIG. 3). Those portions 32, 34 may also be developed, supported, and/or sustained by the filler, if included, as well as the geometric shape of the cavity 20.

The shrinkage rate of the liquid polymer material 38 during solidification is generally in the range of about 50 mm/m to about 2 mm/m regardless of its thermoplastic/thermoset polymer composition. The choice of the polymer composition for the polymer insert 28 and the selective use of the filler permits the shrinkage rate—and thus the size, shape profile, and stiffness of the polymer insert 28—to be varied within this range as needed to meet design and/or performance requirements. A decrease in the shrinkage rate can be attained by an increase in the filler content. The physical attributes of the filler can further direct how shrinkage occurs. The aspect ratio of the particulate filler materials, for example, can be chosen to influence whether the liquid polymer material 38 shrinks isotropically (spherical particles) or anisotropically (planar particles or fiber particles) during solidification. As another example, the shape of the fibrous sheet filler materials (the unidirectional fiber insert or the bidirectional woven fabric insert) can be used to set a rough shape of the polymer insert 28 as well as affect the shrinkage behavior. Still further, the number and relative locations of the portions 32 that lie against the interior surface 22 can be affected by the preliminary shape of the fibrous sheet filler included in the liquid polymer material 38, the amount of the particulate filler included in the liquid polymer material 38, and/or the geometric complexity of the cavity 20.

Of course the method of manufacturing the vibration-damped transmission housing 10 just described is a preferred embodiment. The polymer insert 28 could, alternatively, be separately fabricated and then slid or maneuvered into the cavity 20 to produce the vibration-damped transmission housing 10. This technique works best when the cavity 20 is easily accessible and lacks sharp curves, tight bends, or complex cross-sectional profiles. The manufacturing methods described above are also not limited to a transmission housing; they could easily be practiced with any other type of light metal alloy housing found in the powertrain including an inverter housing, an electric motor housing, and a differential housing. Other light metal alloy parts such as support brackets may also be manufactured by these same methods.

EXAMPLE

This Example demonstrates the vibration damping effect that can be achieved when a polymer insert is introduced into a cavity formed in a light metal alloy part. In this example, three rectangular aluminum alloy specimen blocks were prepared each with a straight, rectangular cavity. The cavities had the same widths and depths but different thicknesses. The first, second, and third aluminum alloy specimen blocks had a cavity thickness of 1.0 mm, 1.2 mm, and 1.5 mm, respectively. Each of the cavities were formed by electric discharge machining. Three polymer inserts composed of 30 wt. % glass fiber filled polybutylene terephthalate and molded separately from the specimen blocks were then slid into the cavities of each block. The polymer inserts were molded to have a thickness slightly less than the thickness of the cavity in which they were introduced. A fourth, solid rectangular aluminum alloy specimen block of similar size was also prepared to serve as a benchmark specimen. The fourth aluminum alloy block did not have a cavity and a residing polymer insert.

Figure 7:
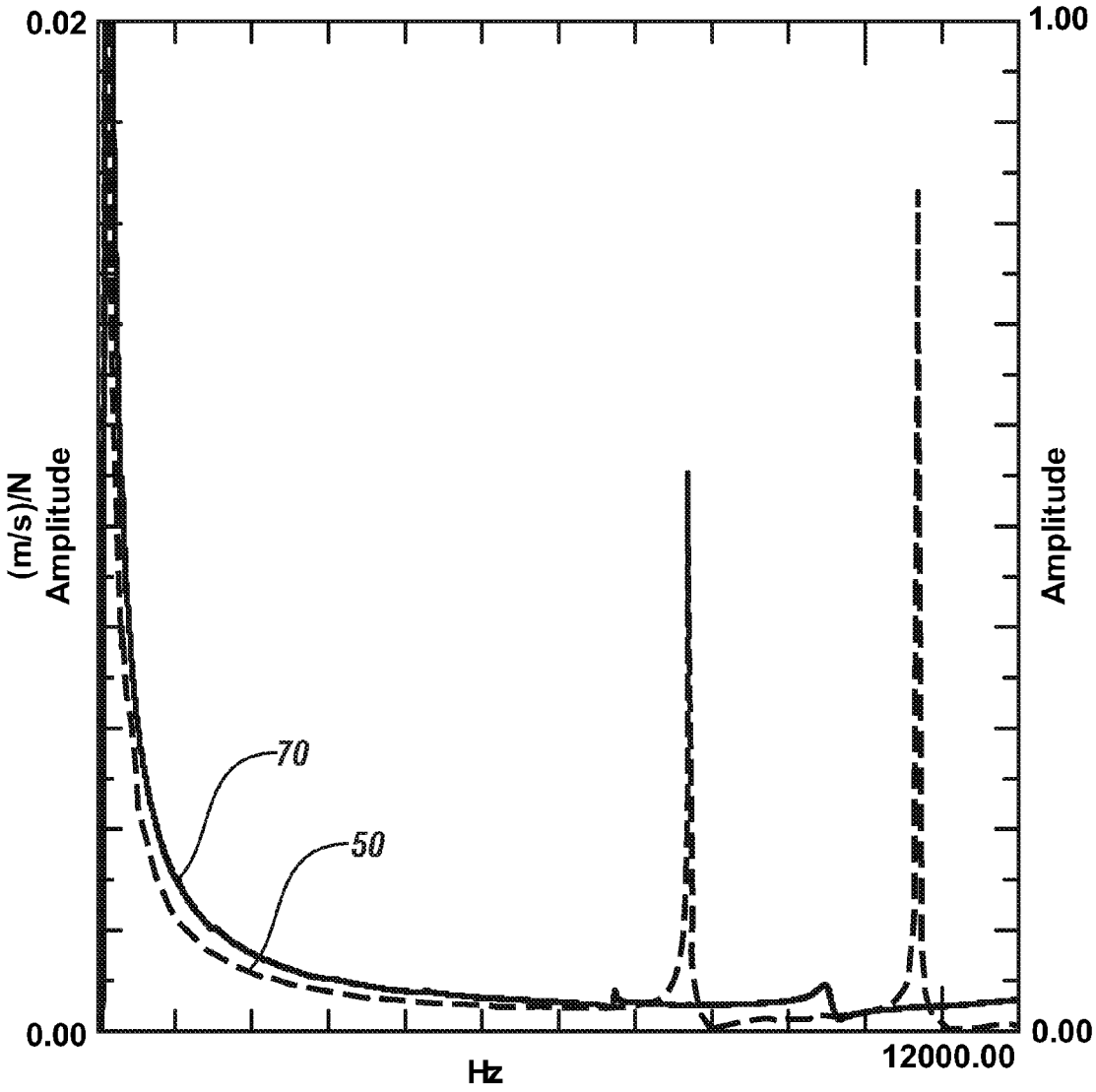
FIG. 7 is a graph that compares the vibrational impact observed after an oscillatory force was applied to a solid aluminum alloy specimen block and a similarly-sized aluminum alloy specimen block that includes a cavity, having a thickness of 1.0 mm, in which a polymer insert resides.
Figure 8:
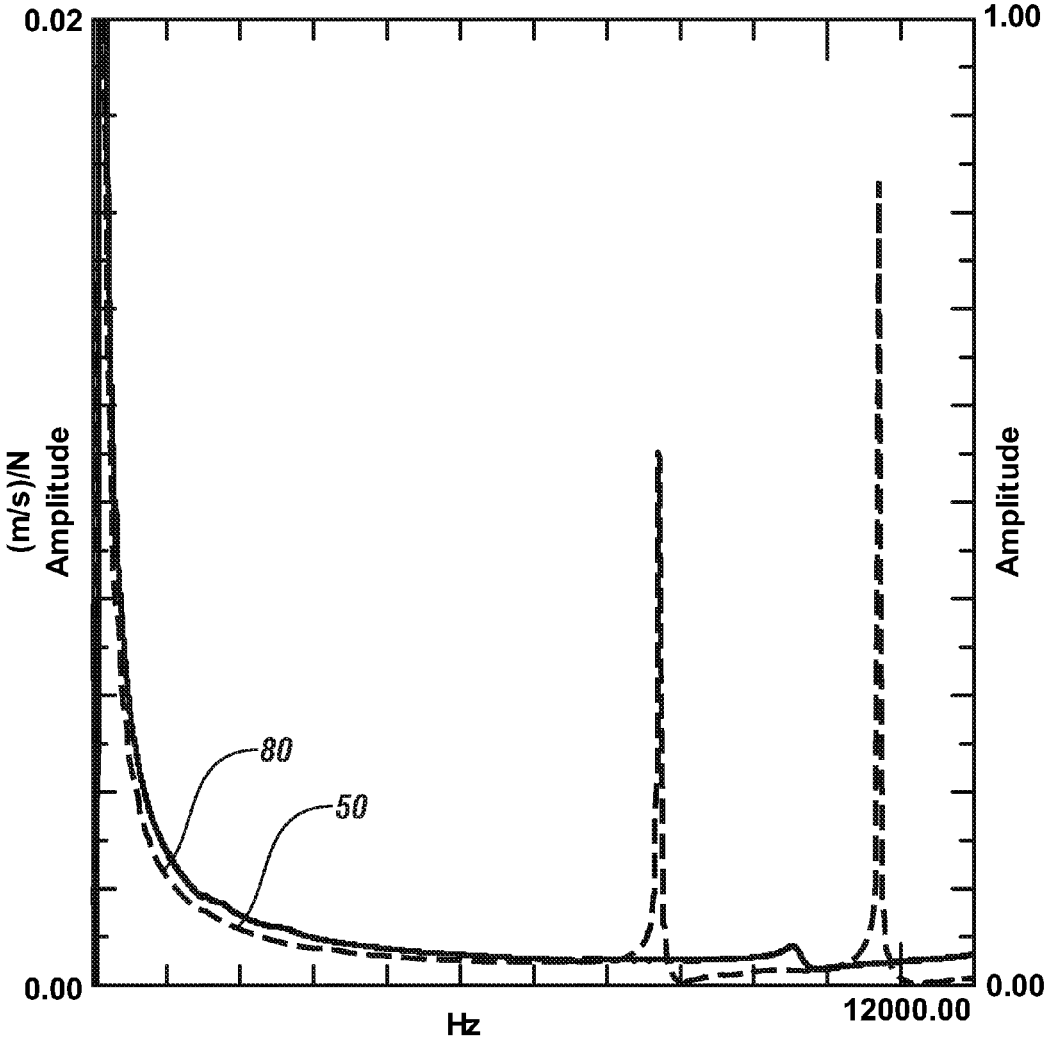
FIG. 8 is a graph that compares the vibrational impact observed after an oscillatory force was applied to a solid aluminum alloy specimen block and a similarly-sized aluminum alloy specimen block that includes a cavity, having a thickness of 1.2 mm, in which a polymer insert resides.
Figure 9:
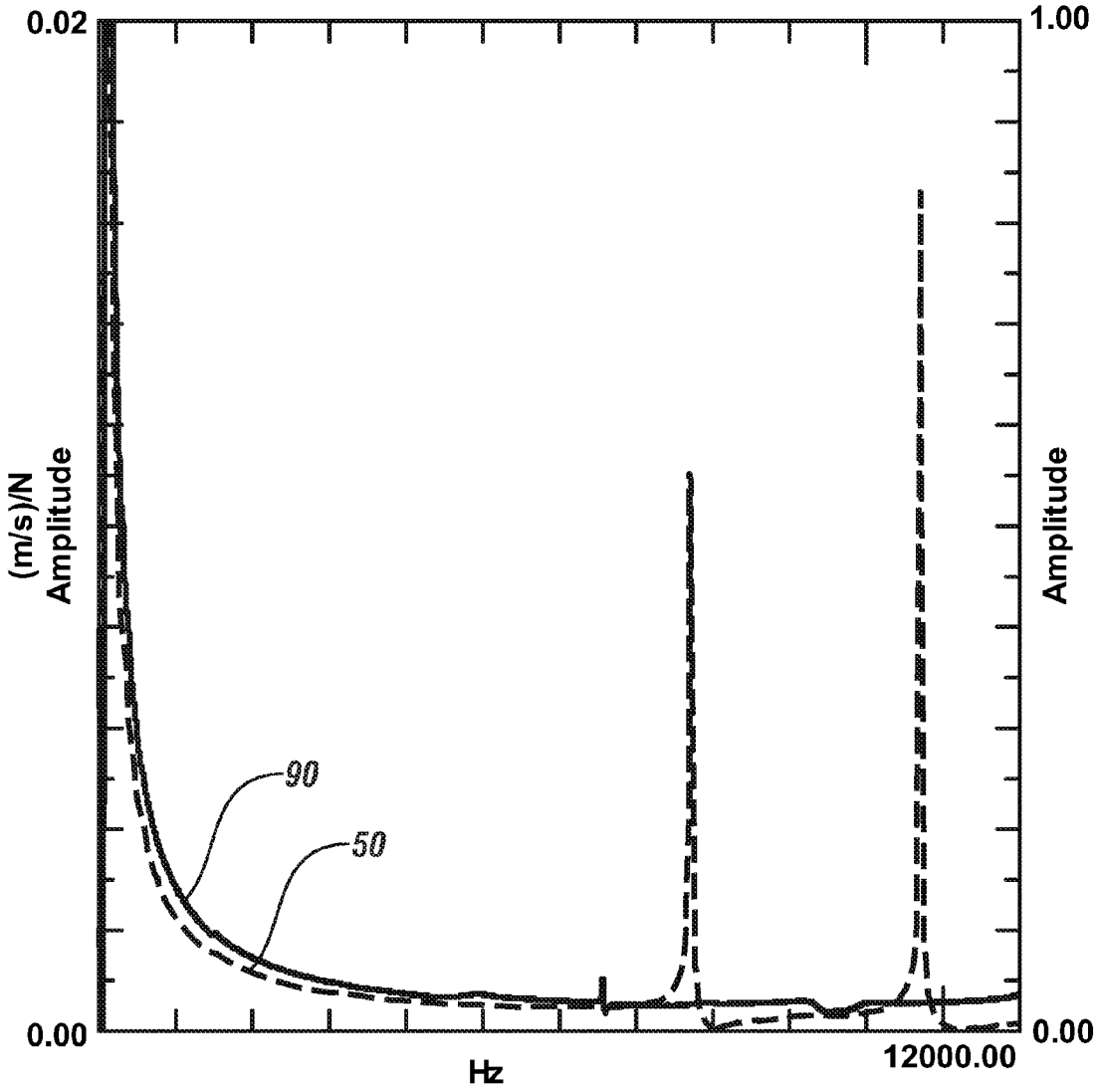
FIG. 9 is a graph that compares the vibrational impact observed after an oscillatory force was applied to a solid aluminum alloy specimen block and a similarly-sized aluminum alloy specimen block that includes a cavity, having a thickness of 1.5 mm, in which a polymer insert resides.

The four aluminum alloy specimen blocks were each subjected to an oscillatory force by an impact accelerometer. The vibrations experienced within the four specimen blocks were measured by conventional frequency response methods. A graph was generated from these measurements that plots vibration amplitude (y-axis) against frequency (x-axis) for each specimen block that included the polymer insert as well as the benchmark specimen block. FIG. 7 shows the measured vibrations that propagated through the first specimen block 70 (cavity width=1.0 mm) in comparison to the benchmark fourth specimen block 50. FIG. 8 shows the measured vibrations that propagated through the second specimen block 80 (cavity width=1.2 mm) in comparison to the benchmark fourth specimen block 50. And FIG. 9 shows the measured vibrations that propagated through the third specimen block 90 (cavity width=1.5 mm) in comparison to the benchmark fourth specimen block 50. As can be seen, the three specimen blocks that had a polymer insert residing within an integrally-formed cavity experienced much less vibration propagation than the solid benchmark specimen block.

The above description of preferred exemplary embodiments and the specific example are merely descriptive in nature and not intended to limit the scope of the claims that follow.

The invention claimed is:

1. A method of manufacturing a vibration-damped, non-ferrous, light metal alloy part that, when installed in a chassis of a vehicle, is prone to vibration propagation and noise transmission during operation of the vehicle, the method comprising:

forming a cavity within a non-ferrous, light metal alloy part at a selected damping region, the cavity being delineated by an interior surface that is provided by either an internally exposed bulk surface of the light metal alloy part or a non-wettable coating overlying the internally exposed bulk surface, wherein the non-ferrous, light metal alloy part is constructed for installation on a chassis of a vehicle; and introducing a polymer insert into the cavity, the polymer insert being sized and shaped so that an exterior surface of the polymer insert can experience relative frictional contacting movement with the interior surface of the cavity when vibrations are imparted to the light metal alloy part at the selected damping region, the exterior surface of the polymer insert comprising a portion that lies against the interior surface of the cavity and a portion that is separated from the interior surface by a gap.

2. The method of claim 1, wherein forming the cavity comprises:

applying a non-wettable coating over the internally exposed bulk surface of the light metal alloy part to provide the interior surface of the cavity before introducing the polymer insert into the cavity, the non-wettable coating comprising at least one of graphite or ceramic particles dispersed and bound within a binder.

3. The method of claim 1, wherein introducing the polymer insert into the cavity comprises:

obtaining a liquid polymer material comprised of either a thermoplastic polymer or an uncured thermoset polymer;

injecting the liquid polymer material into the cavity; and solidifying the liquid polymer material within the cavity and shrinking the liquid polymer material at a controllable shrinkage rate to form the polymer insert.

4. The method of claim 3, wherein introducing the polymer insert into the cavity comprises:

obtaining the liquid polymer material by heating a thermoplastic polymer above a melting temperature of the thermoplastic polymer; and solidifying the liquid polymer material by cooling the liquid polymer material to a temperature below the melting temperature of the thermoplastic polymer.

5. The method of claim 4, wherein the thermoplastic polymer comprises an aliphatic polyamide, a polycarbonate, an aromatic polyamide, a polyacrylic, a polyolefin, or a polyester.

6. The method of claim 3, wherein introducing the polymer insert into the cavity comprises:

obtaining the liquid polymer material by acquiring an uncured thermoset polymer in a liquid state; and solidifying the liquid polymer material by curing the liquid polymer material.

7. The method of claim 6, wherein the thermoset polymer comprises an epoxy, a phenolic, or a polyester.

8. The method of claim 3, further comprising:

accommodating a filler within the liquid polymer material before solidifying the liquid polymer material to control the shrinkage rate.

9. The method of claim 8, wherein the filler has a structure that comprises at least one of spherical particles, planar particles, fiber particles, a fibrous sheet formed of a unidirectional fiber, or a fibrous sheet formed of a bidirectional woven fabric.

10. The method of claim 9, wherein the filler comprises at least one of calcium carbonate, silica, glass, talc, clay, nanoclay, natural or synthetic carbon, an aromatic polyamide, or wollastonite.

11. The method of claim 1, wherein introducing the polymer insert into the cavity comprises:

fabricating the polymer insert separately from the light metal alloy part and in general conformity with the cavity, the polymer insert being comprised of a thermplastic polymer or a thermoset polymer; and sliding the polymer insert into the cavity.

12. The method of claim 11, wherein the thermoplastic polymer comprises an aliphatic polyamide, a polycarbonate, an aromatic polyamide, a polyacrylic, a polyolefin, or a polyester, and wherein the thermoset polymer comprises an epoxy, a phenolic, or a polyester.

13. The method of claim 11, wherein the polymer insert accommodates a filler.

14. The method of claim 13, wherein the filler has a structure that comprises at least one of spherical particles, planar particles, fiber particles, a fibrous sheet formed of a unidirectional fiber, or a fibrous sheet formed of a bidirectional woven fabric, and wherein the filler comprises at least one of calcium carbonate, silica, glass, talc, clay, nanoclay, natural or synthetic carbon, an aromatic polyamide, or wollastonite.

15. The method of claim 1, wherein the light metal alloy part is a housing for a transmission, a housing for an invertor, a housing for an electrical engine, a housing for a differential, or a structural bracket.

16. A method of manufacturing a vibration-damped, non-ferrous, light metal alloy transmission housing, the method comprising:

providing a structural wall of a transmission housing, the structural wall being composed of an aluminum alloy or a magnesium alloy that includes an inner surface and an outer surface, the structural wall defining a cavity between the inner surface and the outer surface, the cavity being delineated by an interior surface; and introducing a polymer insert into the cavity, the polymer insert being sized and shaped so that an exterior surface of the polymer insert can experience relative frictional contacting movement with the interior surface of the cavity when vibrations are imparted to the structural wall at the selected damping region, the exterior surface of the polymer insert comprising a portion that lies against the interior surface of the cavity and a portion that is separated from the interior surface by a gap.

17. The method of claim 16, wherein introducing the polymer insert into the cavity comprises:

obtaining a liquid polymer material comprised of either a thermoplastic polymer or an uncured thermoset polymer;

injecting the liquid polymer material into the cavity; and solidifying the liquid polymer material within the cavity and shrinking the liquid polymer material to form the polymer insert.

18. The method of claim 17, further comprising:

accommodating a filler within the liquid polymer material before solidifying the liquid polymer material to control the shrinkage rate.

19. The method of claim 18, wherein the filler has a structure that comprises at least one of spherical particles, planar particles, fiber particles, a fibrous sheet formed of a unidirectional fiber, or a fibrous sheet formed of a bidirectional woven fabric, and wherein the filler comprises at least one of calcium carbonate, silica, glass, talc, clay, nanoclay, natural or synthetic carbon, an aromatic polyamide, or wollastonite.

20. A method of manufacturing a non-ferrous, light metal alloy part that, when installed in a chassis of a vehicle, is prone to vibration propagation and noise transmission during operation of the vehicle, the method comprising:

providing a non-ferrous, light metal alloy part that defines a cavity within the light metal alloy part at a selected damping region, the cavity having an internally exposed bulk surface of the light metal alloy part, and wherein the non-ferrous, light metal alloy part is constructed for installation on a chassis of a vehicle;

applying a non-wettable coating within the cavity over the internally exposed bulk surface of the light metal alloy part to delineate an interior surface of the cavity;

obtaining a liquid polymer material comprised of either a thermoplastic polymer or an uncured thermoset polymer;

injecting the liquid polymer material into the cavity, the liquid polymer material encompassing a filler when in the cavity; and solidifying the liquid polymer material within the cavity and shrinking the liquid polymer material to form a polymer insert that is sized and shaped so that an exterior surface of the polymer insert can experience relative frictional contacting movement with the interior surface of the cavity when vibrations are imparted to the light metal alloy part at the selected damping region.

* * * * *